US011337002B2

(12) United States Patent
Horbach et al.

(10) Patent No.: US 11,337,002 B2
(45) Date of Patent: May 17, 2022

(54) LOUDSPEAKER SYSTEM WITH ACTIVE DIRECTIVITY CONTROL

(71) Applicant: HARMAN INTERNATIONAL INDUSTRIES, INCORPORATED, Stamford, CT (US)

(72) Inventors: Ulrich Horbach, Canyon Country, CA (US); Matthias Kronlachner, Vilnius (LT)

(73) Assignee: HARMAN INTERNATIONAL INDUSTRIES, INCORPORATED, Stamford, CT (US)

( * ) Notice: Subject to any disclaimer, the term of this patent is extended or adjusted under 35 U.S.C. 154(b) by 0 days.

(21) Appl. No.: 17/001,165

(22) Filed: Aug. 24, 2020

(65) Prior Publication Data

US 2021/0067875 A1 Mar. 4, 2021

Related U.S. Application Data

(60) Provisional application No. 62/895,039, filed on Sep. 3, 2019.

(51) Int. Cl.

| | |
|---|---|
| ***H04R 3/12*** | (2006.01) |
| ***H04R 3/04*** | (2006.01) |
| ***H04R 1/02*** | (2006.01) |
| ***H04R 1/40*** | (2006.01) |

(52) U.S. Cl.

CPC ..... *H04R 3/12* (2013.01); *H04R 1/025* (2013.01); *H04R 1/403* (2013.01); *H04R 3/04* (2013.01); *H04R 2201/401* (2013.01)

(58) Field of Classification Search

CPC ..... H04R 3/12; H04R 1/403; H04R 1/323; H04R 3/04; H04R 2201/4001

See application file for complete search history.

(56) References Cited

U.S. PATENT DOCUMENTS

| | | | |
|---|---|---|---|
| 4,289,929 | A | 9/1981 | Hathaway |
| D262,793 | S | 1/1982 | Hathaway et al. |
| D391,962 | S | 3/1998 | Borys |
| D394,860 | S | 6/1998 | Kitsmiller et al. |
| D466,885 | S | 12/2002 | MacFarlane et al. |
| D471,888 | S | 3/2003 | Solland |
| D491,918 | S | 6/2004 | Solland |
| D595,263 | S | 6/2009 | Jiang |

(Continued)

FOREIGN PATENT DOCUMENTS

JP 2017152857 A 8/2017

OTHER PUBLICATIONS

Machine English translation of JP2017152857A (Year: 2016).*

*Primary Examiner* — James K Mooney

(74) *Attorney, Agent, or Firm* — Brooks Kushman, P.C.

(57) ABSTRACT

A speaker system may include at least two transducers arranged within an enclosure and horizontally aligned with one another; and a processor configured to apply at least one filter to the transducers to generate beamforming audio content, the processor configured to receive input channels and determine a desired filter impulse response at a first frequency point of the input channels. The processor may also be configured to determine a frequency response of the desired filter impulse response at a first angle, and generate a target function based on the frequency response for application at the first angle.

17 Claims, 15 Drawing Sheets

(56) References Cited

U.S. PATENT DOCUMENTS

| | | | | |
|---|---|---|---|---|
| D754,099 | S | 4/2016 | Sung et al. | |
| D758,347 | S | 6/2016 | Hinokio | |
| 9,749,747 | B1 | 8/2017 | Kriegel et al. | |
| D798,931 | S | 10/2017 | Kim et al. | |
| D838,690 | S | 1/2019 | Cheon et al. | |
| D842,903 | S | 3/2019 | You | |
| D853,354 | S | 7/2019 | Demin | |
| 2017/0164100 | A1* | 6/2017 | Franck | H04R 3/005 |
| 2017/0238090 | A1 | 8/2017 | Johnson et al. | |

* cited by examiner

LOUDSPEAKER SYSTEM WITH ACTIVE DIRECTIVITY CONTROL

CROSS-REFERENCE TO RELATED APPLICATIONS

This application claims the benefit of U.S. provisional application Ser. No. 62/895,039 filed Sep. 3, 2019, the disclosure of which is hereby incorporated in its entirety by reference herein.

TECHNICAL FIELD

Disclosed herein are loudspeaker systems with active directivity controls.

BACKGROUND

Desktop speakers paired with home visual equipment such as for use with personal computers, monitors, televisions, etc., are becoming increasingly popular. Such speakers may be used to provide an enhanced listening experience to the user for playback of sounds, media, including videos, audio content, etc. However, most conventional box-shaped loudspeakers may have highly uncontrolled, frequency-dependent directivity characteristics.

SUMMARY

A speaker system may include at least two transducers arranged within an enclosure and horizontally aligned with one another; and a processor configured to apply at least one filter to the transducers to generate beamforming audio content, the processor configured to receive input channels and determine a desired filter impulse response at a first frequency point of the input channels. The processor may also be configured to determine a frequency response of the desired filter impulse response at a first angle, and generate a target function based on the frequency response for application at the first angle.

A speaker system with active directivity control may include a plurality of transducers arranged within an enclosure; and a processor configured to receive input channels, and determine a desired filter impulse response at one of a plurality of frequency points of the input channels. The processor may be further configured to determine a frequency response of the desired filter impulse response at each of a plurality of angles, generate a target function based on the frequency response for application at the angles, and apply at least one filter based on the target function to generate beamforming audio content at the transducers.

A method for active directivity control of a loudspeaker may include receiving input channels, determining a desired filter impulse response at one of a plurality of frequency points of the input channels, determining a frequency response of the desired filter impulse response at each of a plurality of angles, generating a target function based on the frequency response for application at the angles, and applying at least one filter based on the target function to generate beamforming audio content at the transducers.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like-referenced numerals designate corresponding parts throughout the different views.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Disclosed herein is a speaker system having a desktop speaker. The speaker may include a plurality of transducers mounted around the side and the rear of the speaker enclosure. These transducers control the horizontal directivity and eliminate diffraction effects, including those created at low frequencies. Convention box speakers exhibit uncontrolled frequency dependent directivity characteristics that may widen towards low frequencies. The speaker system has a low channel count, low cost, and provides for a highly directive sound source in a small enclosure.

Figure 1:
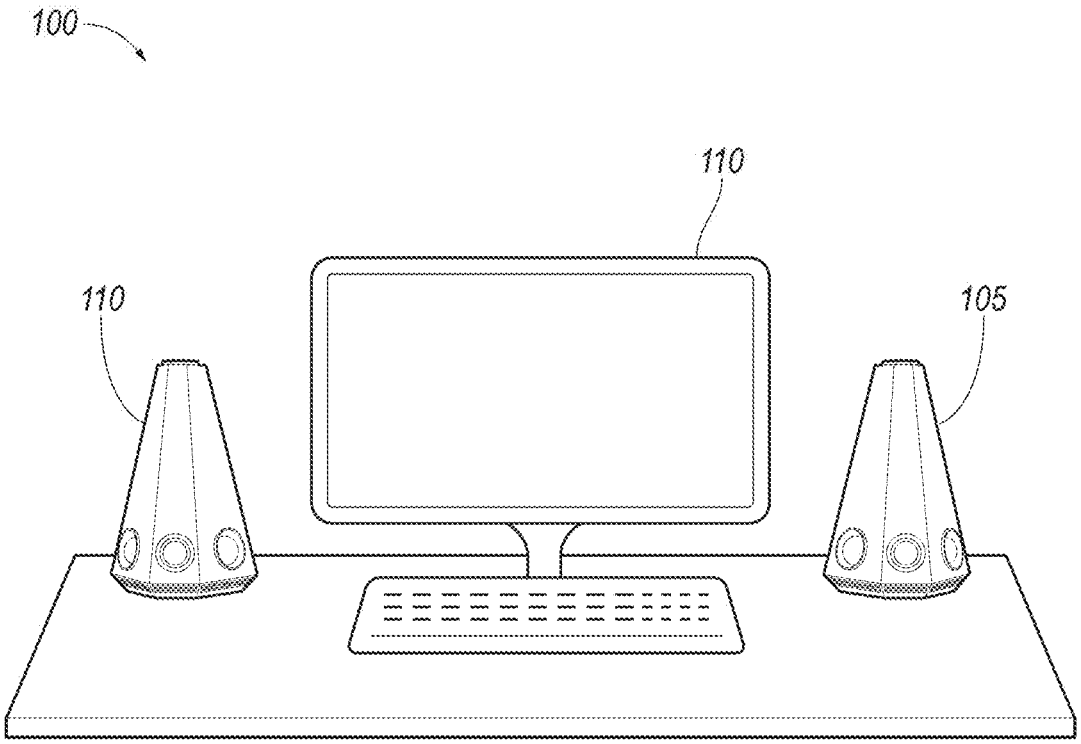
FIG. 1 illustrates an example speaker system.

FIG. 1 illustrates an example speaker system 100 having at least one speaker 105 and a computing device 110. The computing device 110 may include a personal computer, television, tablet, mobile device such as a phone, etc. The computing device 110 may be configured connect to the at least one speaker 105 and provide audio signals to the at least one speaker 105.

The speaker 105 may be a desktop speaker configured to emit audio in response to the audio signal received from the computing device 110. Although two speakers 105 are illustrated in FIG. 1, more or less speakers 105 may be included.

The speaker 105 may be connected to the computing device 110 via a wired connection, or a wireless connection such as BLUETOOTH, a local area network such as WiFi™ a cellular network, etc.

This tabletop speaker 105 may have beamforming/diffraction control techniques. Such signal processing capabilities include an overall reduction of reflected/diffuse sound, higher precision, lower coloration, more natural sound, sound being directed towards the listener, rear energy suppressed. Binaural techniques, such as a cross talk canceller, may require a precise sound source with minimized early reflections to work best, enabling 3D audio and gaming applications.

Figure 2:
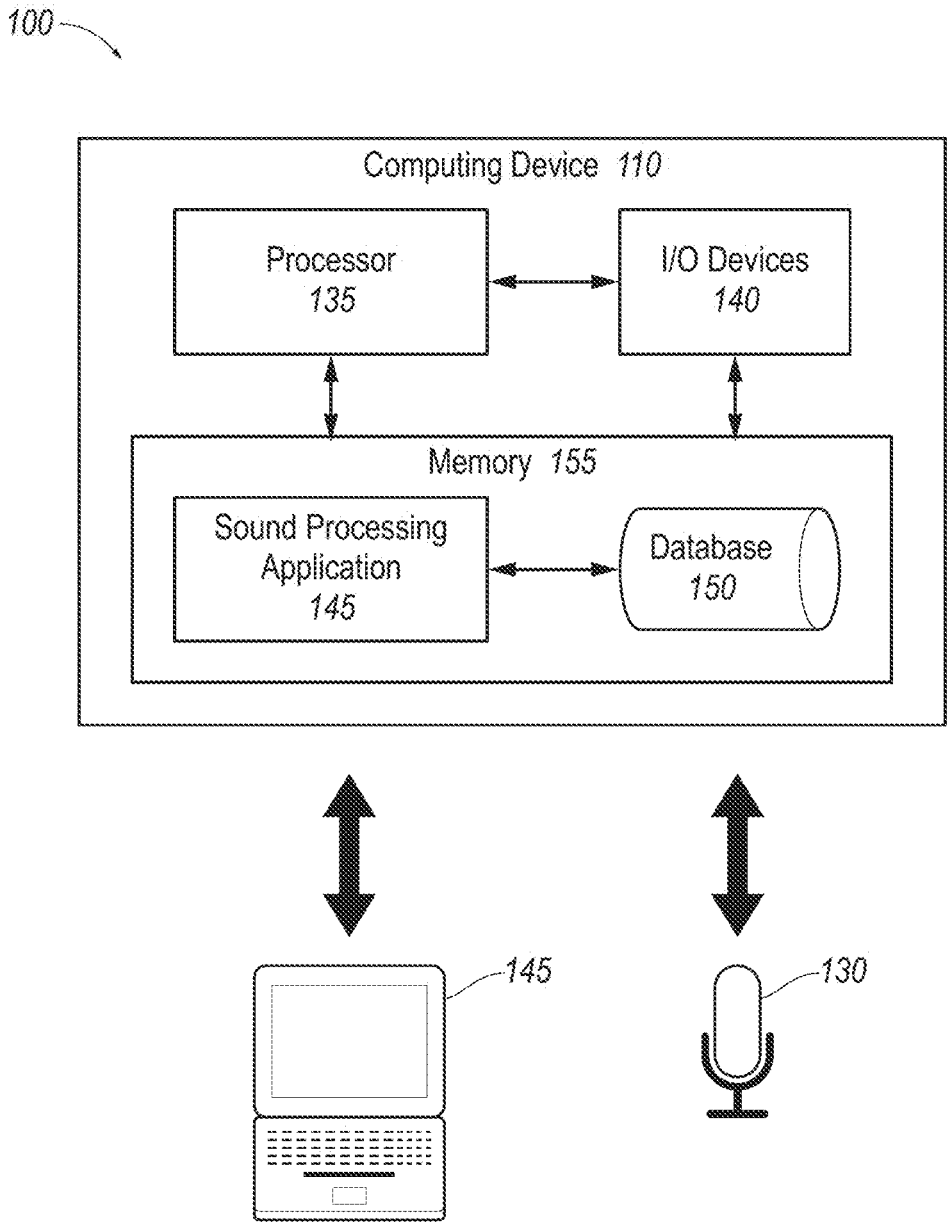
FIG. 2 illustrates a conceptual block diagram of the speaker system.

FIG. 2 is a conceptual block diagram of the example speaker system 100 configured to implement one or more aspects of the various embodiments. As shown, the speaker system 100 may include the computing device 110, one or more speakers 105, and one or more microphones 130. The computing device 110 includes a processor 135, input/output (I/O) devices 140, and a memory 150. The memory 150 includes an audio processing application 3112 configured to interact with a database 150.

The processor 135 may be any technically feasible form of processing device configured to process data and/or execute program code. The processor 135 could include, for example, and without limitation, a system-on-chip (SoC), a central processing unit (CPU), a graphics processing unit (GPU), an application-specific integrated circuit (ASIC), a digital signal processor (DSP), a field-programmable gate array (FPGA), and so forth. Processor 135 includes one or more processing cores. In operation, processor 135 is the master processor of computing device 110, controlling and coordinating operations of other system components.

I/O devices 140 may include input devices, output devices, and devices capable of both receiving input and providing output. For example, and without limitation, I/O devices 140 could include wired and/or wireless communication devices that send data to and/or receive data from the speaker 105, the microphone 130, remote databases, other audio devices, other computing devices, etc.

The memory 155 may include a memory module or a collection of memory modules. The audio processing application 145 within memory 155 may be executed by the processor 135 to implement the overall functionality of the computing device 110 and also the speaker 105 and, thus, to coordinate the operation of the audio system 100 as a whole. For example, and without limitation, data acquired via one or more microphones 130 may be processed by the audio processing application 145 to generate sound parameters and/or audio signals that are transmitted to one or more speakers 105. The processing performed by the audio processing application 145 may include, for example, and without limitation, filtering, statistical analysis, heuristic processing, acoustic processing, and/or other types of data processing and analysis.

The speaker 105 may be configured to generate sound based on one or more audio signals received from the computing system 100 and/or an audio device (e.g., a power amplifier) associated with the computing system 100. The microphone 130 may be configured to acquire acoustic data from the surrounding environment and transmit signals associated with the acoustic data to the computing device 110. The acoustic data acquired by the microphone 130 could then be processed by the computing device 110 to determine and/or filter the audio signals being reproduced by the speaker 105. In various embodiments, the microphone 130 may include any type of transducer capable of acquiring acoustic data including, for example and without limitation, a differential microphone, a piezoelectric microphone, an optical microphone, etc.

Generally, computing device 110 is configured to coordinate the overall operation of the audio system 100. In other embodiments, the computing device 110 may be coupled to, but separate from, other components of the audio system 100. In such embodiments, the audio system 100 may include a separate processor that receives data acquired from the surrounding environment and transmits data to the computing device 110, which may be included in a separate device, such as a personal computer, an audio-video receiver, a power amplifier, a smartphone, a portable media player, a wearable device, etc. However, the embodiments disclosed herein contemplate any technically feasible system configured to implement the functionality of the audio system 100.

Figure 3:
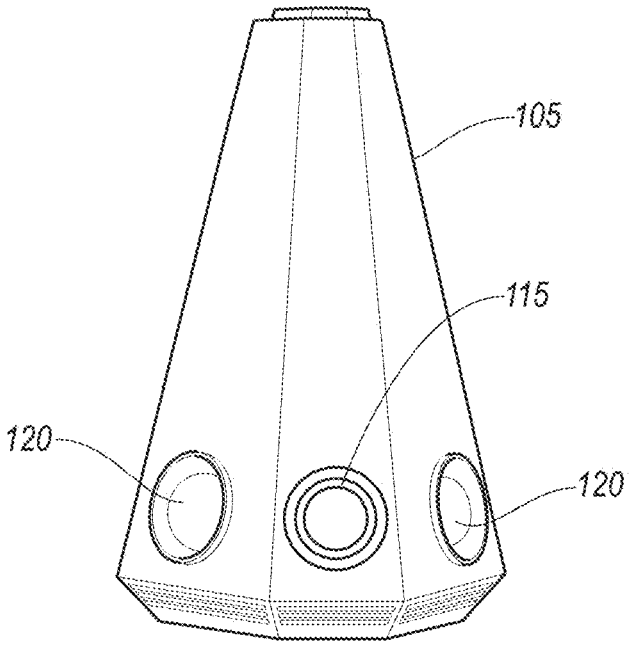
FIG. 3 illustrates an example perspective front view of a speaker.

FIG. 3 illustrates an example perspective front view of the speaker 105. The pyramid-shaped enclosure may include a front facing tweeter, flanked by a pair of midranges radiating at +/−45°, and a single rear midrange. All drivers are mounted close to the table surface, in order to minimize path length differences between direct and reflected sound at a vertical listening angle. Although the enclosure is illustrated as a pyramid-shape, other configuration may be realized such as cylindrical, cubic, etc.

The speaker 105 may include transducers arranged around the body thereof. A central tweeter section may include at least one high frequency driver 115, or tweeter. A midrange section may be arranged on each side of the tweeter section and include midrange drivers 120. Although not shown, a subwoofer may also be included.

Figure 4:
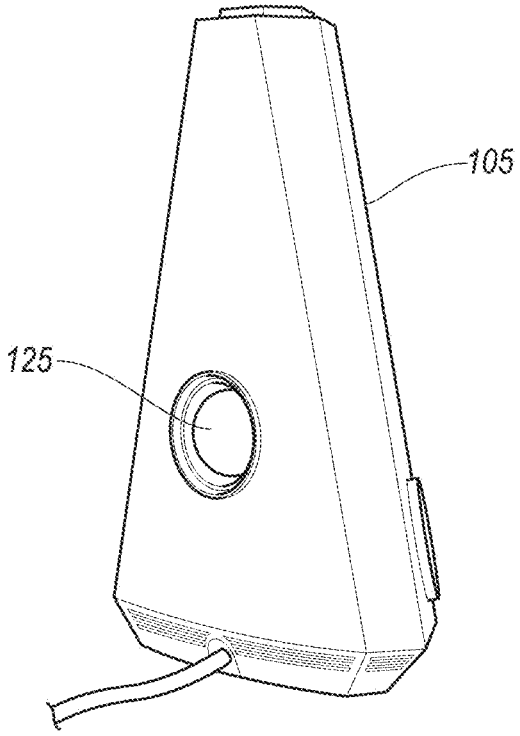
FIG. 4 illustrates an example perspective rear view of the speaker.

FIG. 4 illustrates an example perspective rear view of the speaker 105. A rear portion, or rear midrange portion, may include a rear midrange driver 125. Each driver (e.g., the tweeter 115, front midrange 120, and rear midrange 125) may provide beam control.

Beamforming is a technique that may be used to direct acoustic energy in a preferred direction. The speaker 105, such as the examples shown in FIG. 1, may use acoustic beamforming to shape a sound field for the speaker 105.

As explained above, the speaker 105 may include or be in communication with the processor 135 (e.g., a digital signal processor/CODEC component) configured to provide the signal processing for beamforming. Input to the signal processor may include mono or left and right stereo channels. Output from the signal processor may include a plurality of channels, the outputs including content based on various filtering and mixing operations to direct the beams from each driver.

For the purpose of beamforming, the frequency bands may be handled separately. In an example, the loudspeaker may separately handle high-frequency, midrange and bass frequencies. As a specific possibility, the high-frequencies may be output from the signal processor in 12 channels to 24 tweeters; the midrange may be output from the signal processor in 8 channels to 8 midrange drivers; and the bass may be output from the signal processor in two channels to four bass drivers. In another example, the loudspeaker may be two-way and may separately handle high and low frequencies.

Figure 5:
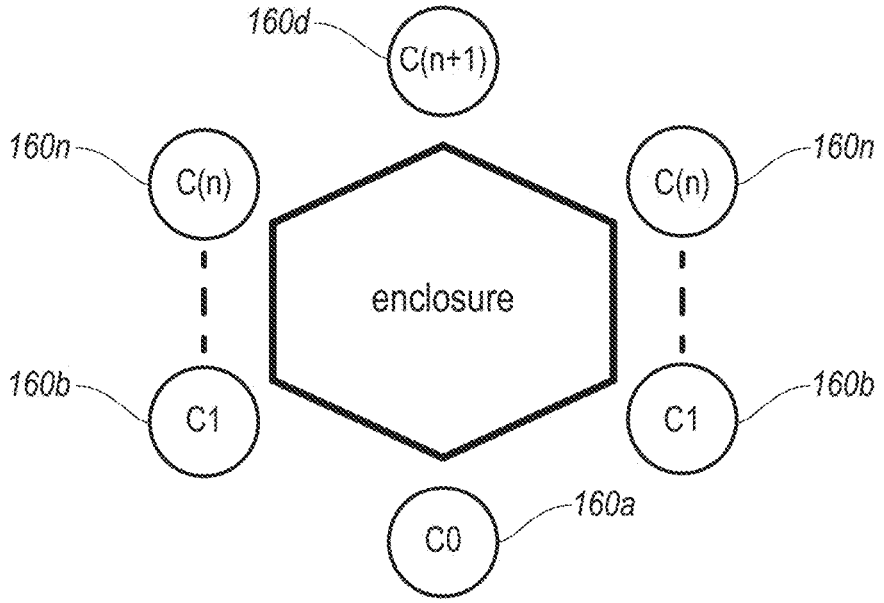
FIG. 5 illustrates an example driver layout around the enclosure of the speaker.

FIG. 5 illustrates an example driver layout around the enclosure of the speaker 105. Typically, transducers, such as tweeters, midranges, and woofers, are mounted into an enclosure of a given shape. The transducers may be mounted at the same height, though do not necessarily need to be. The transducers may be driven by digital filters 160, 0 . . . n+1. A left/right symmetry may be assumed. These filters, shown for illustrative purposes in FIG. 5, may include a first filter 160*a* configured to drive a first front transducer, or the tweeter 115. A pair of second filters 160*b* may drive a respective pair of transducers, such as the front midrange drivers 120. An nth pair of third filters 160*n* may drive a respective additional pair of drivers. The third filters 160*n* may be configured to drive transducers arranged at a larger angle and attached to the enclosure. Typically, "n" may have a value between one and three, which corresponds to three to five filter channels. Paired drivers are hard-wired and measured as such. A fourth filter 160*d* may drive the rear transducer, such as the rear midrange driver 125.

Figure 27:
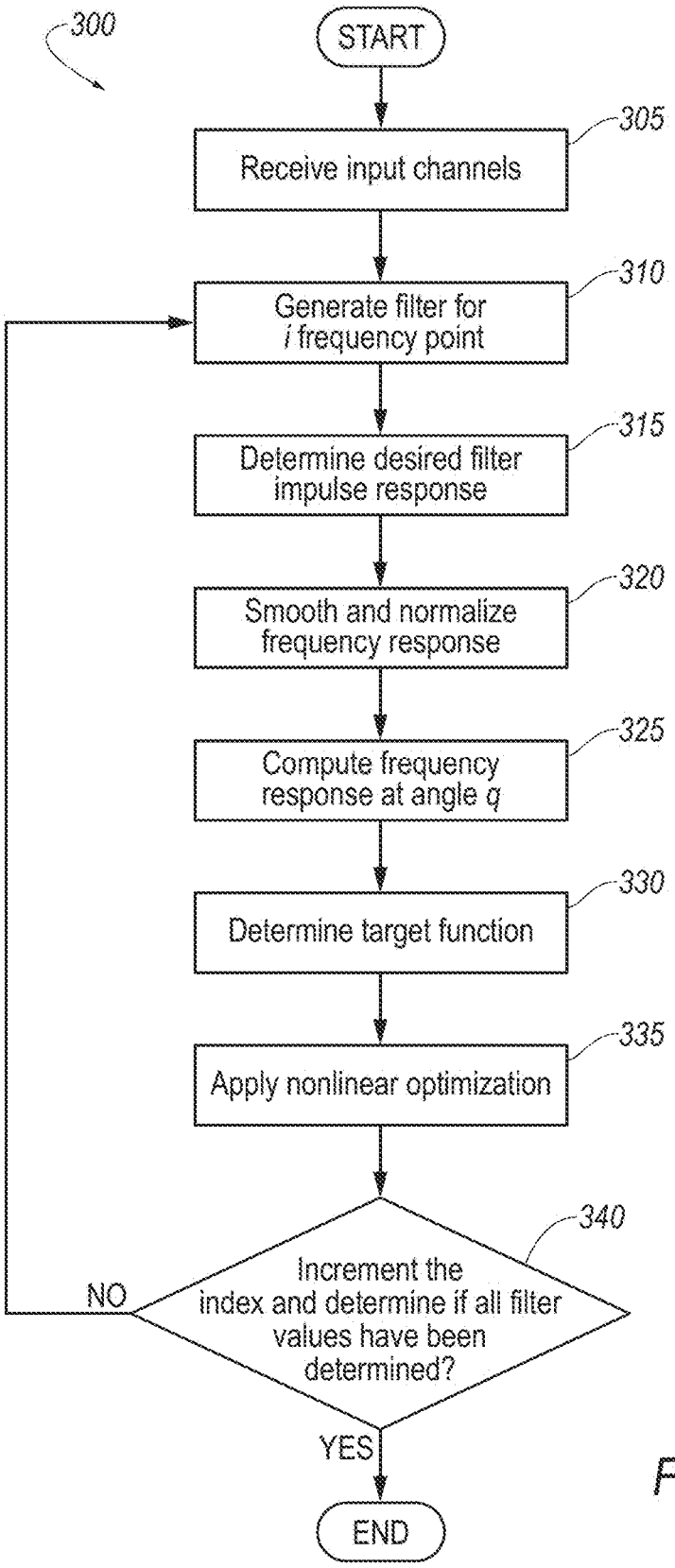
FIG. 27 illustrates an example beamforming process.

A filter design system is described in more detail with respect to FIG. 27. A start solution may include M complex spectral values (index i) of the filters $C_r$ as $$C_{r,start}(i)=H_r(i), r=0 \ldots n+1, i=1 \ldots M.$$

The discrete Fourier transform (DFT) length M is typically 256 . . . 4096. The processor 135 may determine a solution for each frequency point i, then determine the desired filter impulse responses by inversing the DFT once all M complex frequency values are found. $H_r(i)$ are high pass, band pass or low pass filters and may include, for example, fourth order Butterworth filters. The forward pointing transducer is usually the tweeter 115, which requires $H_o$ to be a high pass filter of corner frequency (2 . . . 5) KHz (−3 dB).

The following iterative design procedure may be based on measured frequency responses of all drivers at incremental angles around the enclosure:

$$H_{DR}(q,r,i),$$

where q=1, . . . , Q is the angular index, r the driver (or driver pair) index, i the frequency index. The frequency responses are smoothed, and normalized to the frontal response of driver 1 (q=1, r=1), as explained in detail in US Patent Application 2019/0200132. Due to symmetry, the data may be captured at a half circle 0 . . . 180° only, in typically 15° steps (Q=13).

The system frequency responses at angle q, U(q, i), can be computed as the complex sum of all drivers, with beamforming filters applied:

$$U(q,i)=\Sigma_{r=0}^{n+1} C_r(i) H_{DR}(q,r,i).$$

A real-valued target function is defined T(q, i) specifying the desired system responses. The target function may specific beam shape or coverage. Examples for different target functions are described herein.

A nonlinear optimization routine is applied at each frequency point that minimizes the error:

$$e(i)=\sqrt{\Sigma_{q=1}^{Q} w(q)(|U(q,i)/a|-T(q,i))^2}.$$

where w(q) is a weighting function that can be used to improve the result at a desired angle, at the expense of other angles. The parameter a is the array gain that specifies how much louder the array plays compared to one single driver. Typically, the parameter is higher than one, but should not be higher than the total number of drivers. In order to allow some amount of sound cancellation that is necessary for super-directive beam forming, the array gain may be smaller than the number of drivers.

Instead of real and imaginary parts, magnitude $|C_r(i)|$ and phase $\arg(C_r(i))=\arctan(\mathrm{im}\{C_r(i)\}/\mathrm{Re}\{C_r(i)\})$ are selected for the nonlinear optimization routine as variables.

This bounded, nonlinear optimization problem can be solved with standard software.

The following bounds are selected:

$$G_{max}=20*\log(\max(|C_r|)),$$

the maximum allowed filter gain, and lower and upper limits for the magnitude values from one calculated frequency point to the next point, specified by an input parameter 8

$$|C_r(i)|\cdot(1-\delta)<|C_r(i+1)|<|C_r(i)|\cdot(1+\delta)$$

in order to control smoothness of the resulting frequency response and ensure the solution does not deviate significantly from the above defined start solution $C_{r,start}$, the first frequency point in the band of interest is:

$$i = i_1 = \left[\frac{f_1}{f_a}\cdot N\right]$$

(for example $f_1$ = 300 Hz, $f_g$ = 24 KHz, $N$ = 2048 => $i_1$ = 25), then subsequently filter values are determined by incrementing the index each time until the last point is reached $$i = i_2 = \left[\frac{f_2}{f_g}\cdot N\right] \text{(e.g. } f_2 = 3 \text{ KHz} \Rightarrow i_2 = 256\text{)}.$$

Figure 6:
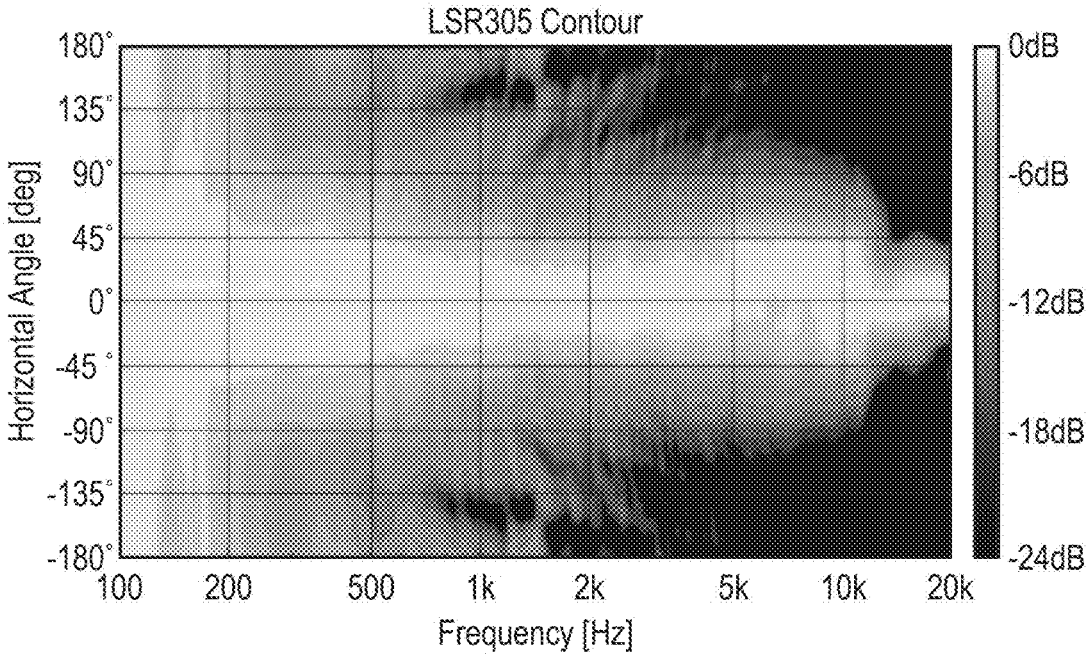
FIG. 6 illustrates a contour plot of an example high-frequency response for various angles around a conventional box speaker.

FIG. 6 illustrates a contour plot of an example high-frequency response for various angles around typical speakers. Most conventional box-shaped loudspeakers with multiple drivers and passive crossover networks exhibit highly uncontrolled, frequency-dependent directivity characteristics. This is the case of FIG. 6. Here, sound pressure levels at a distance of two meter, measured in an anechoic chamber, at horizontal angles −180 . . . 180 degrees around the speaker in a plane at tweeter height. The example is a professional grade two-way design with waveguide attached to the tweeter, which results in well controlled, uniform directivity within a limited frequency band of about (1.5 . . . 10) KHz. However, below that lower corner frequency of 1.5 KHz, where the woofer takes over, directivity widens and becomes largely uncontrolled. Sonically, this results in more and more diffuse sound towards low frequencies in a listening room due to reflections, causing stereo images to widen and become blurred. Voices and instruments typically to not sound coherent in space, but fall apart into more defined images above, and wider images of unnatural width below the crossover frequency. Using waveguides or horns for the woofer would solve the problem, but is in general not practical due to their required sizes, which must be comparable to the acoustic wavelength (for example one meter at 300 Hz).

In the speaker system 100, the speaker 105 appreciates active diffraction and directivity control with a limited number of additional loudspeaker drivers that are mounted at the side and rear of the loudspeaker enclosure. Digital FIR (finite impulse response) filters may be designed to approximate a prescribed target function for the sound pressure levels off axis. The enclosure may therefore be much smaller than the acoustic wavelengths where control is achieved, as in so-called "super-directive beamformers."

Beamformers may be used in the form of multi-way, steerable, circular arrays. However, high channel count, size, and processing requirements lead to very high cost of such systems. The audio system 100 may include lower cost systems with limited channel counts of two to four, but without steering capability. This may be applicable to home stereo and surround systems, table top systems, professional sound reinforcement, and car audio.

Figure 7:
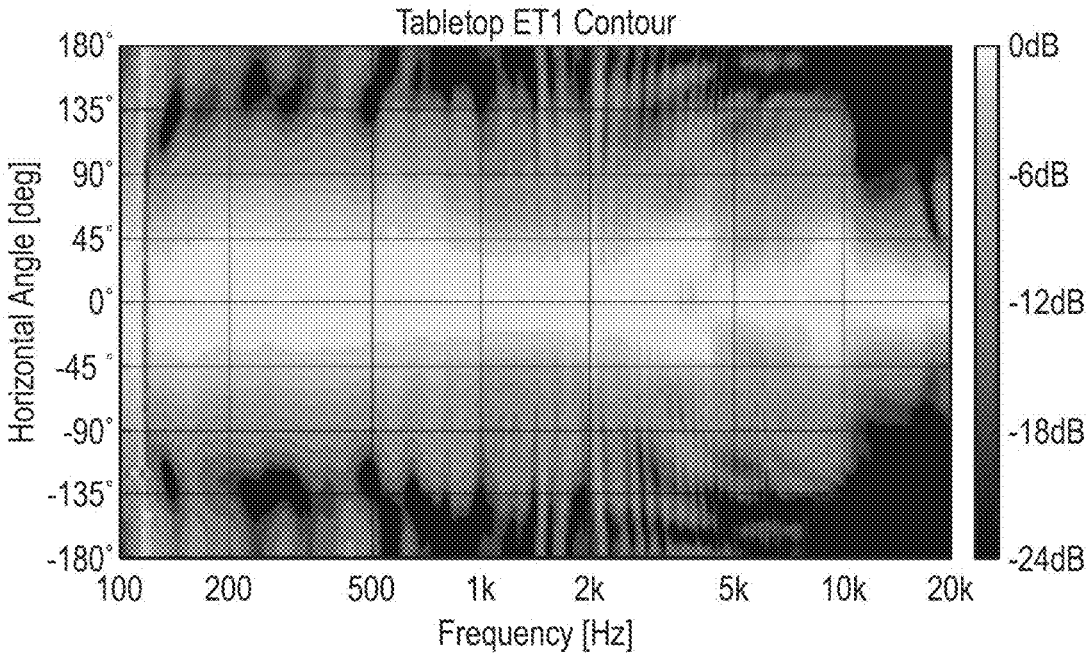
FIG. 7 illustrates a contour plot of an example high-frequency response for various angles around the speaker.

FIG. 7 illustrates a contour plot of an example high-frequency response for various angles around the speaker 105 of the audio system 100. In this example, a more controlled response is realized in comparison with the radiated sound shutdown at 150 Hz as shown in FIG. 6 and despite of its small size compared with the acoustic wavelength. Below 150 Hz, a conventional subwoofer may take over.

The parameters for the example shown in FIG. 7, which may illustrate an example response for a desktop system, may include:

n=1 transducer pairs;

start solutions $C_0$: forth order Butterworth high pass, $f_c$=2 kHz; $C_1$=1; $C_2$=1 (no filters);

target function T=[−1 −3 −4 −6 −8 −10 −12 −14 −16 −18 −18 −20]/dB at angles [15 30 45 60 75 90 105 120 135 150 165 180] degrees;

weighting function w=[1 1 1 1 1 1 1 1 1 1 1 10];

frequency band 1 (100-800 Hz): array gain a=2, deviation bound=2; and frequency band 2 (800 Hz-8 KHz): array gain a=1, deviation bound=0.2.

Figure 8:
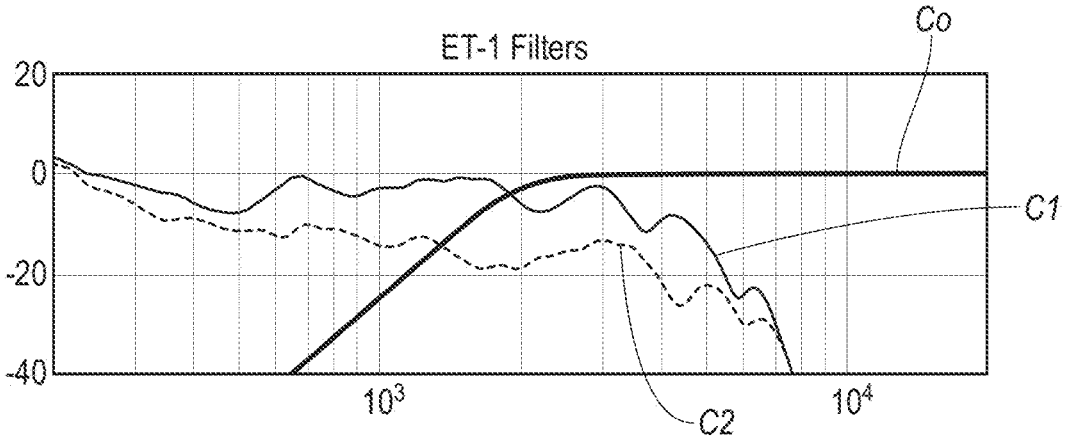
FIG. 8 illustrates example beamforming filter responses of FIG. 7.

FIG. 8 illustrates example beamforming filter responses of FIG. 7.

Figure 9:
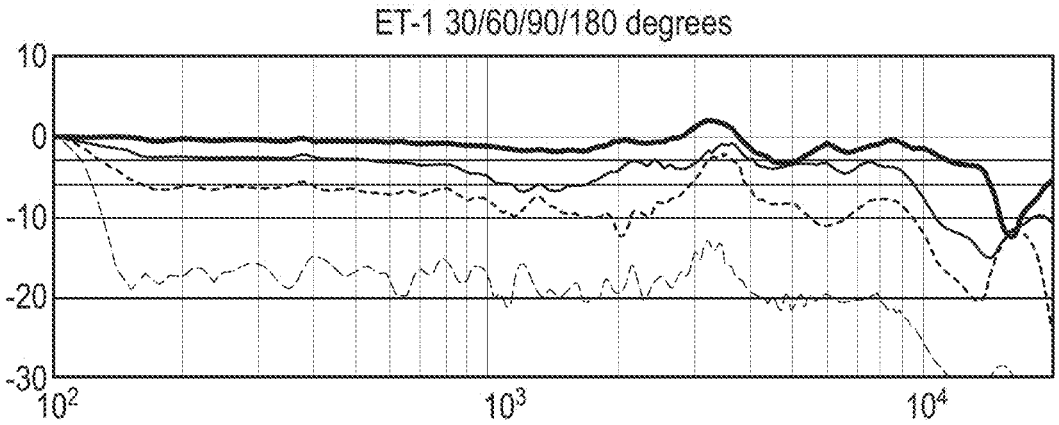
FIG. 9 illustrates an example performance plot versus selected target angles for the example of FIG. 7.

FIG. 9 illustrates an example performance plot versus selected target angles for the example of FIG. 7. In this example, the axis may be off by attenuations of 30/60/90/180 degrees. As shown, the filters are smooth, do therefore not exhibit much time dispersion (preringing), and require very limited low frequency gain, which is important to achieve sufficient dynamic range.

Figure 10:
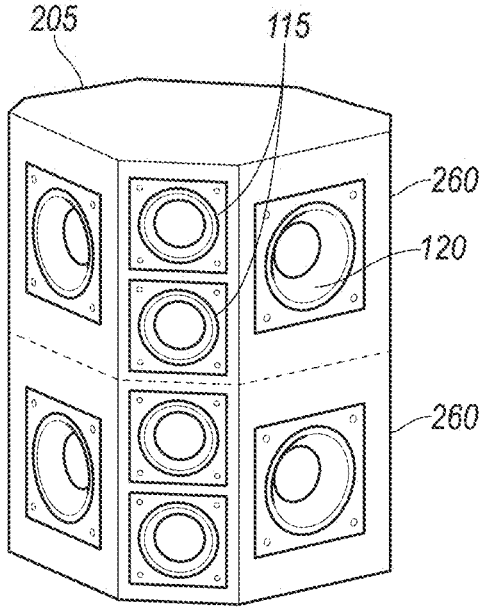
FIG. 10 illustrates a front perspective view of another example speaker.
Figure 11:
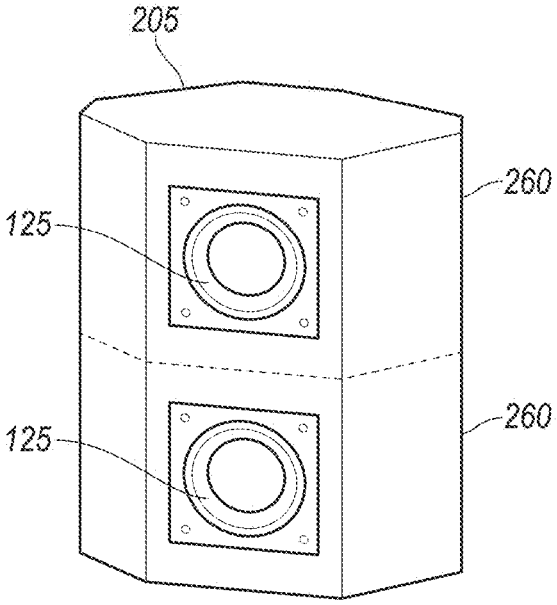
FIG. 11 illustrates a back perspective view of the speaker of FIG. 10.

FIG. 10 illustrates a front perspective view of a speaker 205 having a linear array. FIG. 11 illustrates a back perspective view of the speaker 205 in FIG. 10. This speaker 205 includes two stacked modules 260 having a total height of 26 cm. One module 260 may include two front tweeters 115, one pair of woofers 120, and a rear woofer 125.

The examples in FIGS. 10 and 11 may be applicable in large scale applications such as venues, churches etc., In these situations, horizontal and vertical directivity control are often required. Existing methods may have a crossover circuit based on a directivity target and a frequency-independent attenuation factor at a defined vertical off-axis angle. However, the acoustic output power may be limited in such a system, because the center section requires a small tweeter at low crossover point.

Popular in such applications are line arrays that feature vertical directivity control, with wide dispersion patterns horizontally, unless some directivity is achieved by passive, acoustic means. With the disclosed active beamforming methods, more precise and frequency independent patterns horizontally may be achieved by stacking the modules to form a line array.

Figure 12:
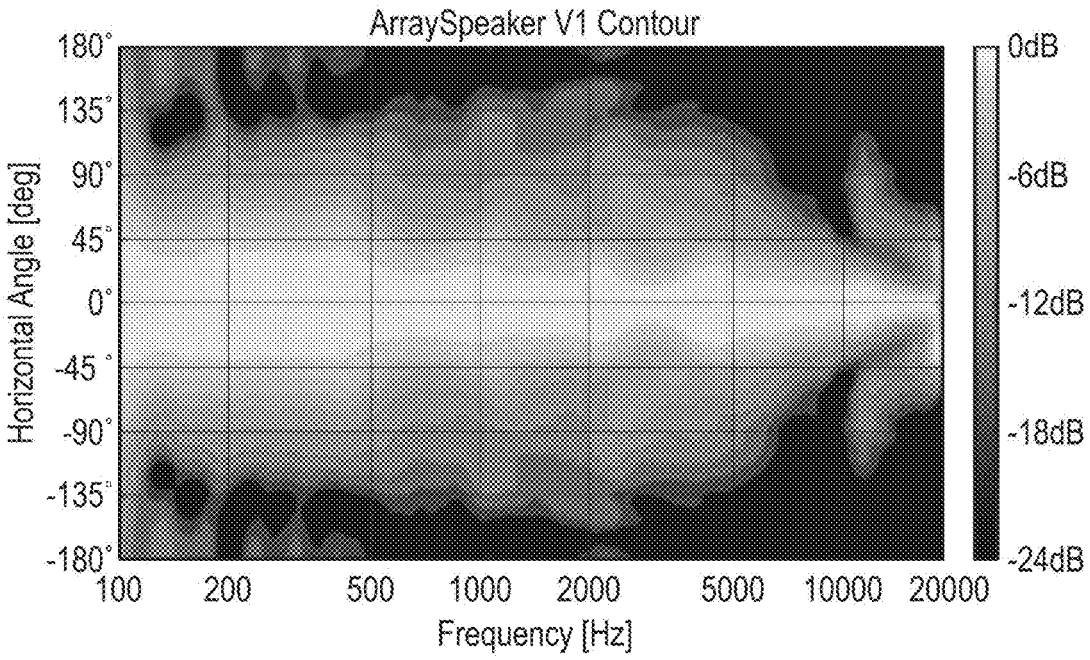
FIG. 12 illustrates a contour plot of an example high-frequency response for various angles around the stacked array of FIGS. 10 and 11.

FIG. 12 illustrates a contour plot of an example high-frequency response for various angles around the stacked array of FIGS. 10 and 11. Notably, the beam narrows above 5 kHz due to the large membrane size of the tweeters 115. In this example, the tweeters 115 may be 2.5 inches.

The parameters for the example shown in FIG. 12 may include:

n=1 transducer pairs;

start solutions $C_0$: forth order Butterworth high pass, $f_c$=800 Hz; $C_1$: forth order BW low pass, $f_c$=2500 Hz; $C_2$: forth order BW low pass, $f_c$=600 Hz;

target function T=[−1 −3 −4 −6 −8 −10 −12 −14 −16 −18 −18 −20]/dB at angles [15 30 45 60 75 90 105 120 135 150 165 180] degrees;

weighting function w=[1 1 1 1 1 1 1 1 1 1 1 10];

array gain a=1.4, deviation bound g=2.

Figure 13:
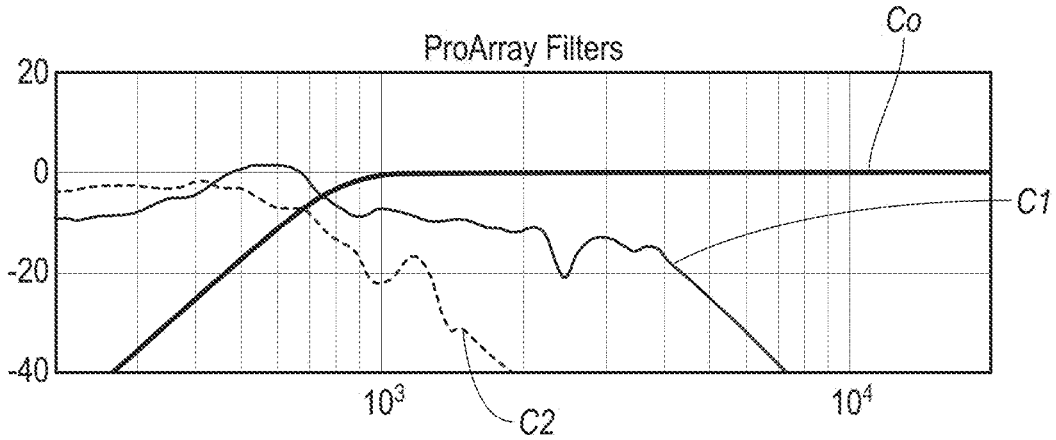
FIG. 13 illustrates example beamforming filter responses of FIG. 12.

FIG. 13 illustrates example beamforming filter responses of FIG. 12.

Figure 14:
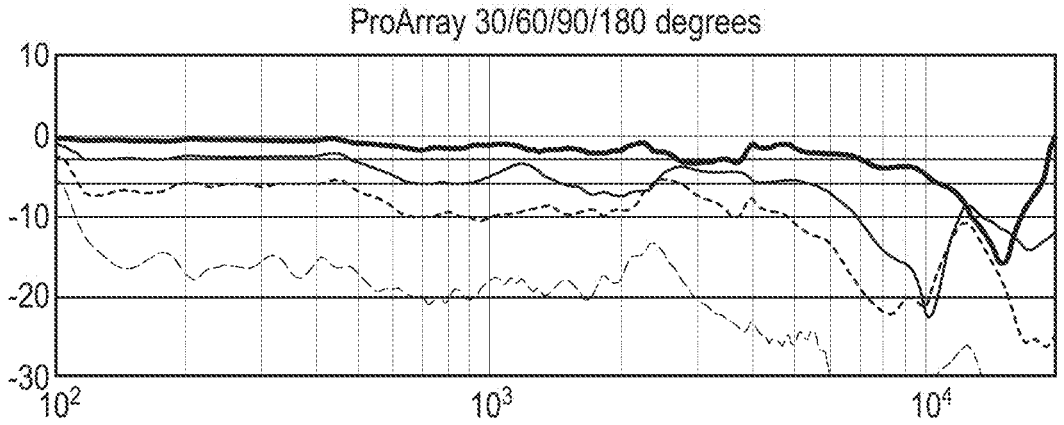
FIG. 14 illustrates an example performance plot versus selected target angles for the example of FIG. 12.

FIG. 14 illustrates an example performance plot versus selected target angles for the example of FIG. 12.

Figure 15:
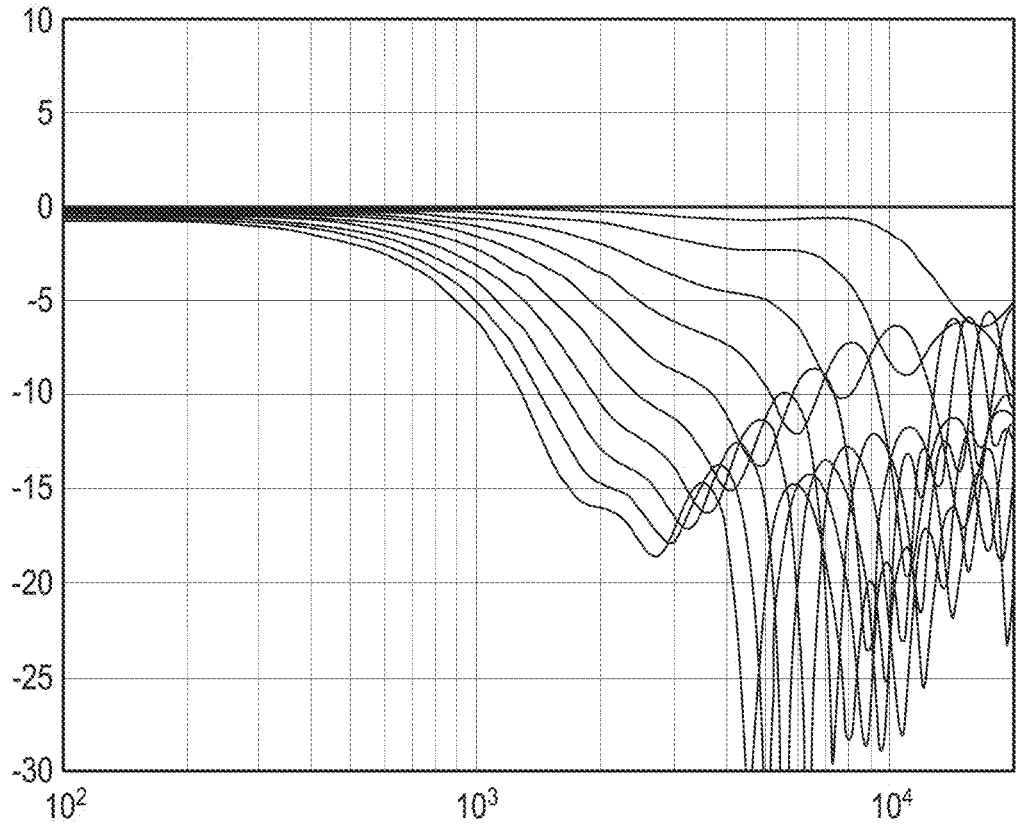
FIG. 15 illustrates a nearfield response of five stacked modules.

FIG. 15 illustrates a nearfield response of five stacked modules including vertical responses off axis 0 . . . 1 m, in 10 cm steps, at 2.5 m listening distance. The total array height may be approximately 0.65 m. Directivity is highly frequency dependent, and limited to high frequencies above 1 KHz. For a professional application, the array length may be increased in order to increase the effective bandwidth of the vertical beam.

Figure 16:
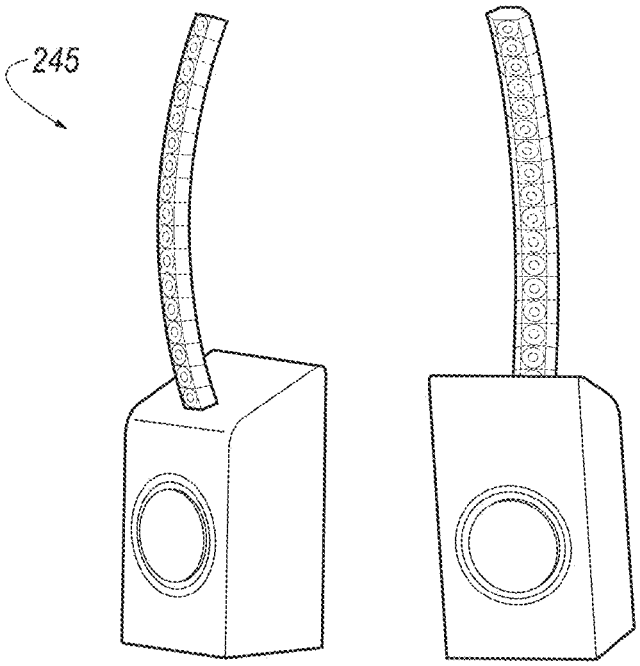
FIG. 16 illustrates an example CBT array.

FIG. 16 illustrates an example CBT array system 245. Curved line arrays with cosine-shaped attenuation may provide a more uniform response. The example in FIG. 16 may be designed to approximate a cardioid characteristic horizontally, with the method presented here. It may be mounted on a two-channel woofer with a similar, first order cardioid response.

Figure 17A:
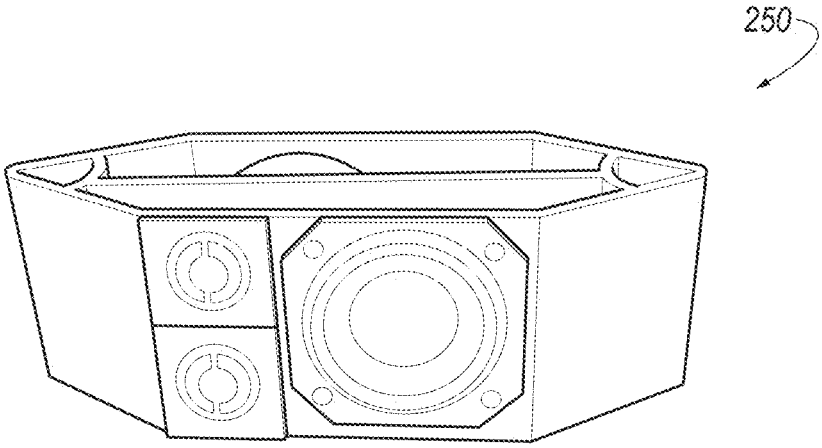
FIG. 17*a* and FIG. 17*b* illustrate an example single array element with front and rear midrange drivers, and two stacked front tweeters.
Figure 17B:
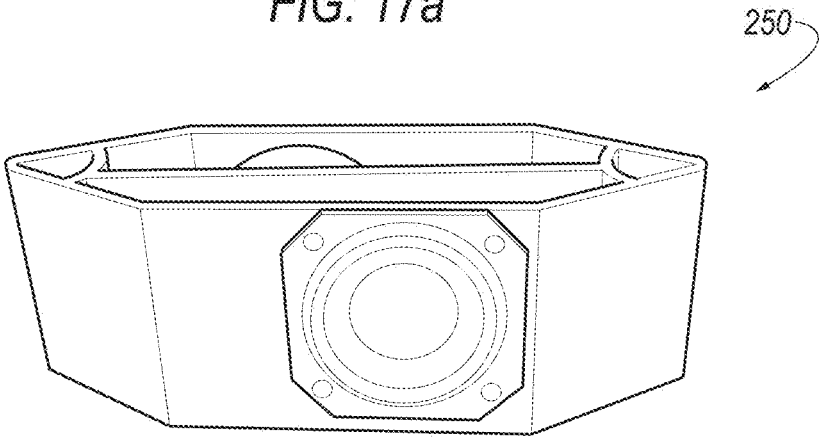

FIG. 17*a* and FIG. 17*b* illustrate an example single array element 250 with front and rear midrange drivers, and two stacked front tweeters. The tweeters may be crossed over at 5 KHz, and may not be part of the horizontal beam forming. The single array element may have a height of approximately 6.0 cm.

Figure 18:
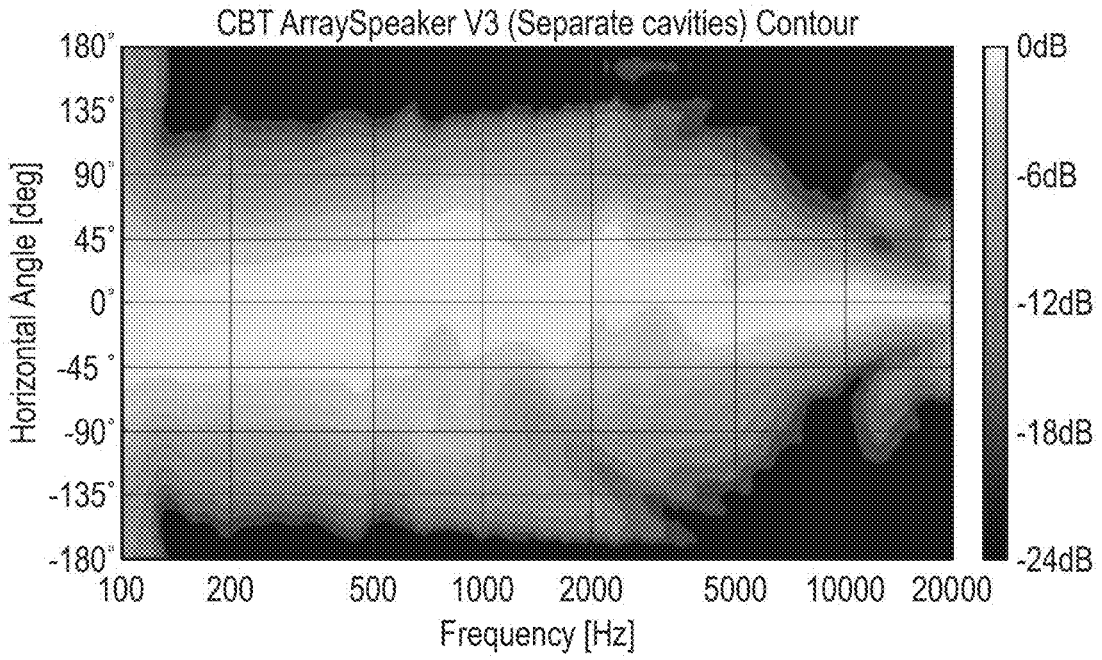
FIG. 18 illustrates a contour plot of an example high-frequency response for various angles around the single array element of FIGS. 17*a* and 17*b;*

FIG. 18 illustrates a contour plot of an example high-frequency response for various angles around the single array element of FIGS. 17*a* and 17*b*. Notably, the response is wider, since there is no driver pair at the sides, but exhibits a strong null at 180 degrees (cancellation of rear sound).

Figure 19:
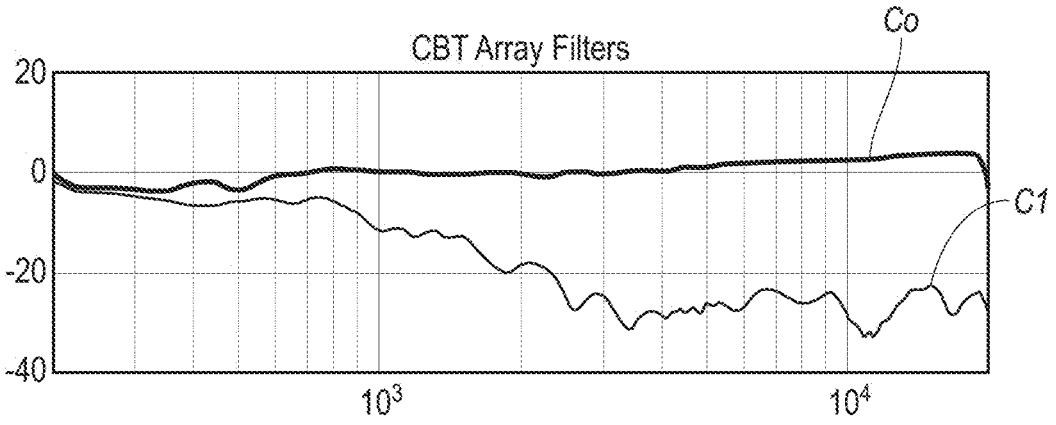
FIG. 19 illustrates example beamforming filter responses of FIG. 18.

FIG. 19 illustrates example beamforming filter responses of FIG. 18.

Figure 20:
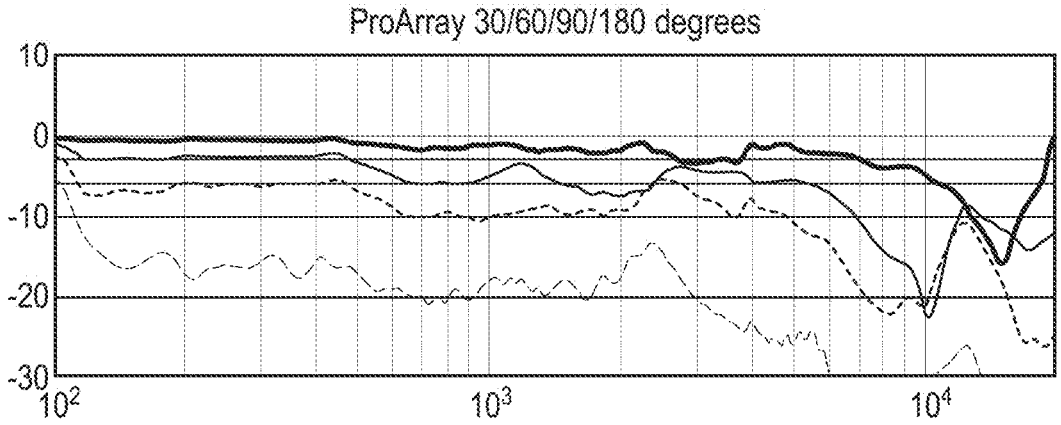
FIG. 20 illustrates an example performance plot versus selected target angles for the example of FIG. 18.

FIG. 20 illustrates an example performance plot versus selected target angles for the example of FIG. 18.

The parameters for the example shown in FIG. 18 may include:

n=0 transducer pairs;

start solutions $C_0$=1; $C_1$: second order BW low pass, $f_c$=500 Hz;

target function T=[−0.1 −0.44 −1 −2 −3.3 −5.1 −7.6 −11.0 −15 −22 −30 −40]/dB at angles [15 30 45 60 75 90 105 120 135 150 165 180] degrees (approximates a first order cardioid);

weighting function w=[1 1 1 1 1 1 1 1 1 1 1 5]; and array gain a=1.0, deviation bound g=4.

Figure 21:
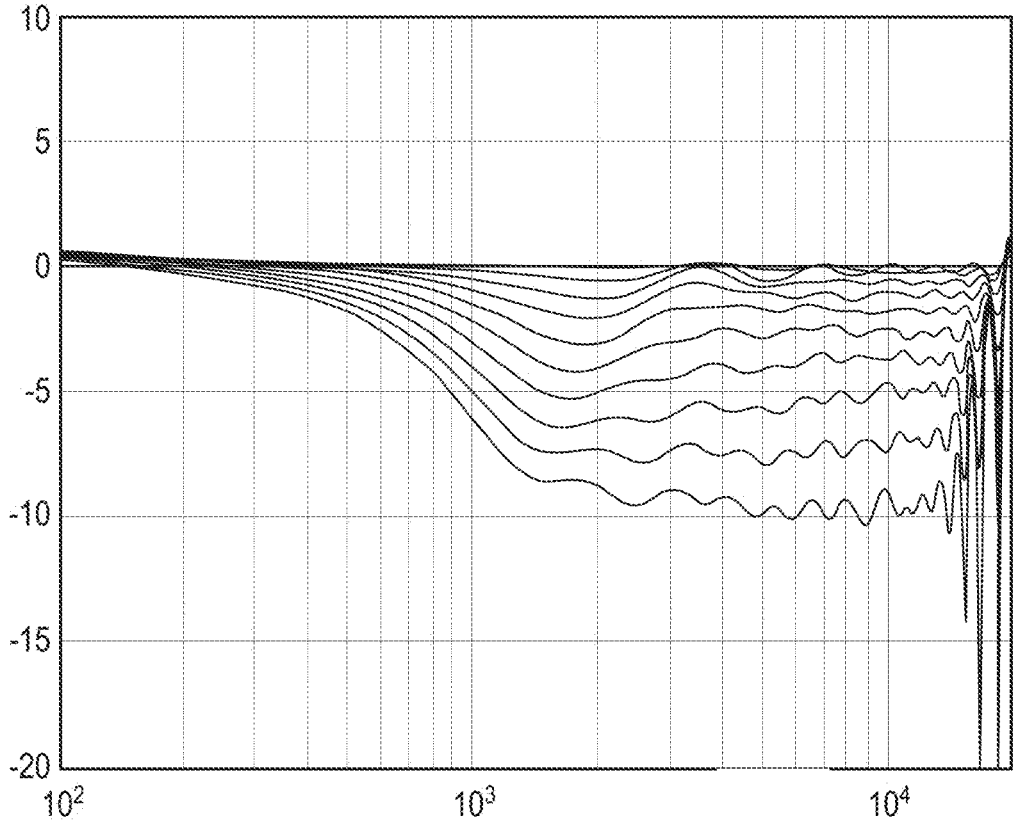
FIG. 21 illustrates example simulated nearfield responses.

FIG. 21 illustrates an example simulated nearfield responses. As shown, the response confirms uniformity and constant directivity of the CBT array, compared with the line array of FIG. 15.

Figure 22:
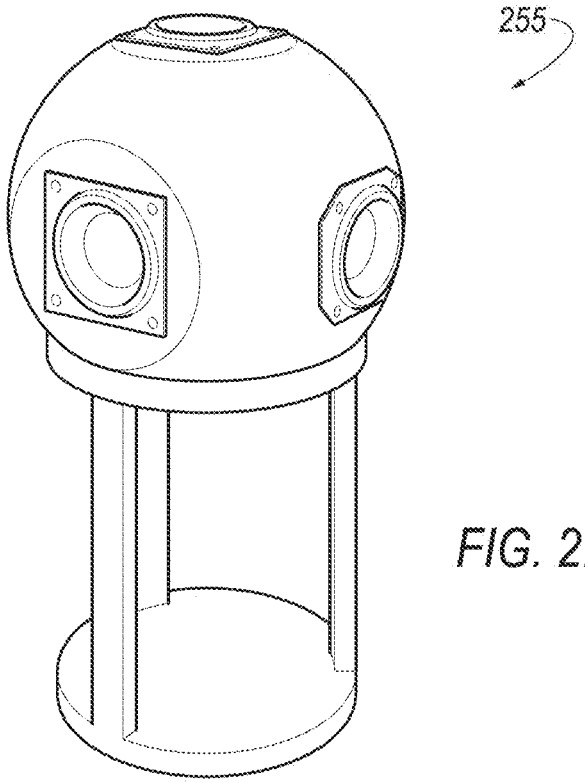
FIG. 22 illustrates a perspective view on an example 3D cardioid speaker array for car applications.

FIG. 22 illustrates a perspective view on an example 3D cardioid speaker array 255 for car applications. In this example, the speaker may aim to realize a higher order cardioid characteristic in three dimensions. The speaker may include six transducers, mounted in a disc shaped enclosure of size 144 mm Ø×134 mm. The transducer may include a forward pointing driver, a rear pointing driver, and four transducers around the sides, which are electrically connected to each other. The side transducers may be configured to suppress sound at 90 degrees off axis. With a pair of such speakers, a personal sound system can be realized in a car, to produce stereo sound for the driver or a passenger, while suppressing sound for the other passengers.

Figure 23:
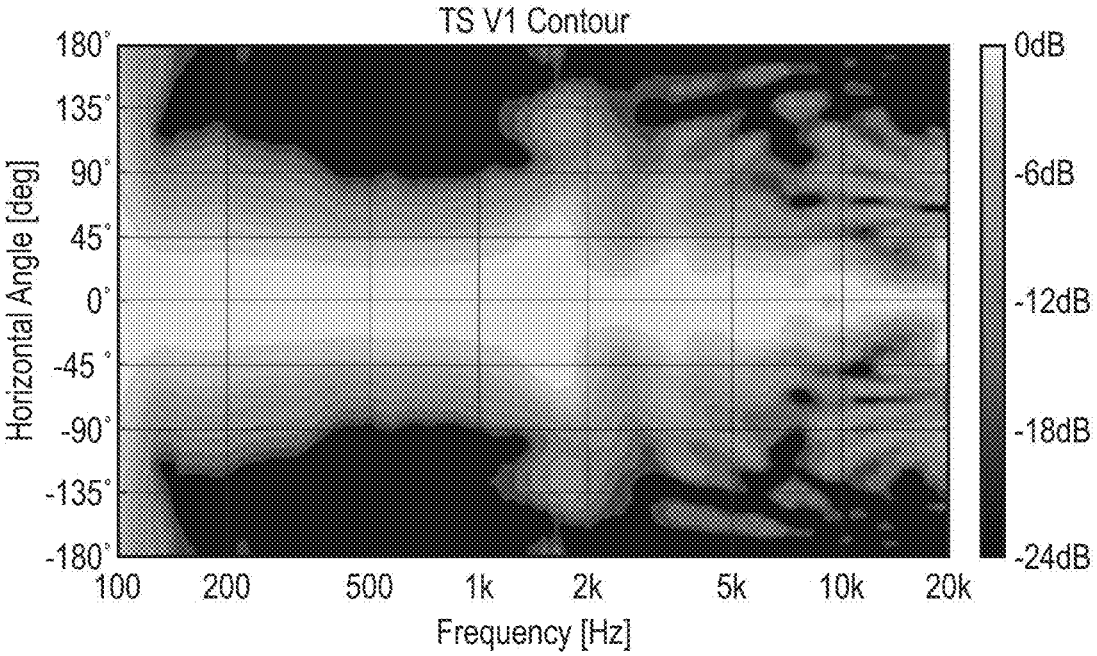
FIG. 23 illustrates a contour plot of an example high-frequency response for various angles around the 3D speaker of FIG. 22.

FIG. 23 illustrates a contour plot of an example high-frequency response for various angles around the 3D speaker 255 of FIG. 22. As shown, a narrow beam and good suppression is realized above 90 degrees. The iteration was divided into two frequency bands. Below 1 KHz, the target function may be a third order cardioid, and above 1 KHz, a second order cardioid.

Figure 24:
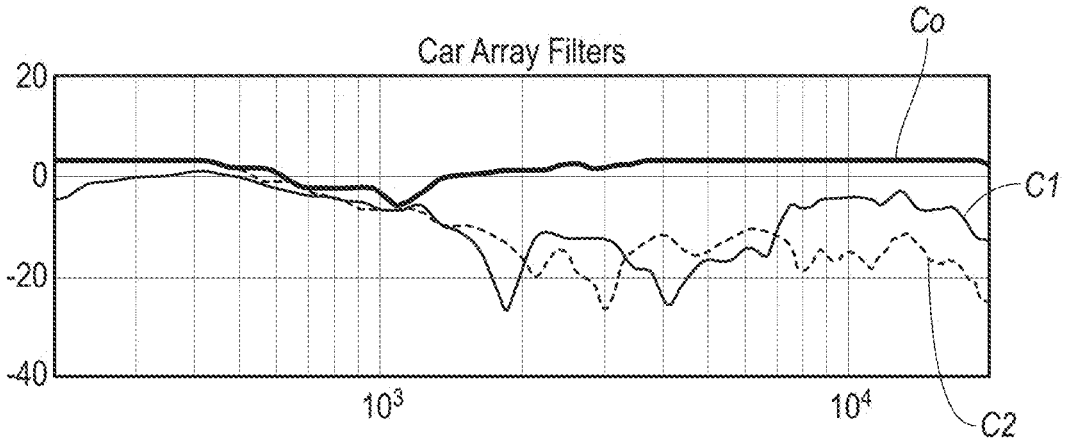
FIG. 24 illustrates example beamforming filter responses of FIG. 23.

FIG. 24 illustrates example beamforming filter responses of FIG. 23.

Figure 25:
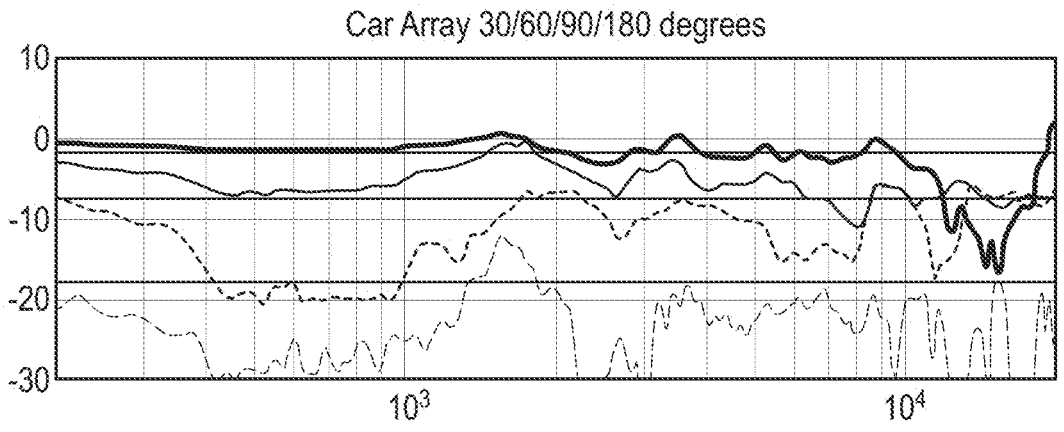
FIG. 25 illustrates an example performance plot versus selected target angles for the example of FIG. 23.

FIG. 25 illustrates an example performance plot versus selected target angles for the example of FIG. 23.

The parameters for the example shown in FIG. 23 may include:

n=1 transducer pairs;

start solutions $C_0$=$C_1$=$C_2$=1, target function T=[−0.4 1.8 4.1 7.5 12 18 26 30 30 30 30 30]/dB below, and T=[−0.3 −1.2 −2.8 −5 −8 12 17 24 30 30 30] above 1 kHz;

weighting function w=[1 1 1 1 1 1 1 1 1 1 1 5]; and array gain a=2, deviation bound g=2.

Figure 26A:
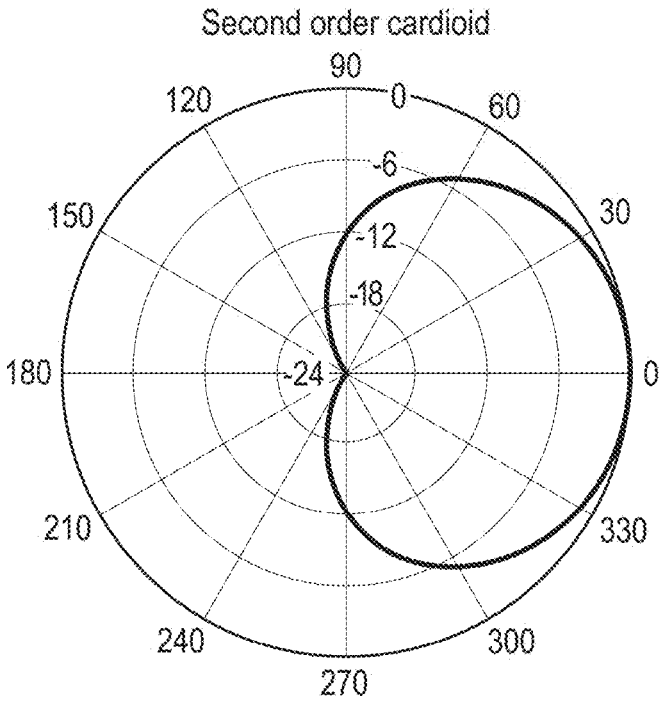
FIG. 26*a* illustrates a computed polar response of a second order cardioid.

FIG. 26*a* illustrates a computed polar response of a second order cardioid.

Figure 26B:
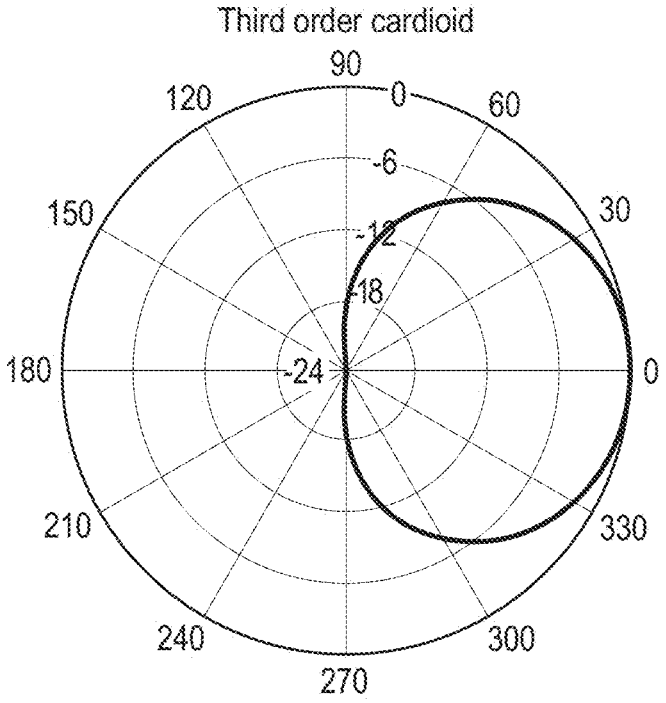
FIG. 26*b* illustrates a computed polar response of an example third order cardioid.

FIG. 26*b* illustrates a computed polar response of an example third order cardioid.

FIG. 27 illustrates an example beamforming process 300. At block 305, the processor 135 may receive an input channel at the loudspeaker 105 for processing. The input may include mono channel, while in some examples stereo channel or more channels may be provided.

At block 310, the processor 135 may generate a first filter based on measured frequency responses of each driver including taking M complex spectral values (index i) of the filters $C_r$ as $$C_{r,start}(i)=H_r(i), r=0 \ldots n+1, i=1 \ldots M.$$

As explained above, the discrete Fourier transform (DFT) length M is typically 256 . . . 4096. The processor 135 may determine a solution for each frequency point i.

At block 315, the processor 135 may then determine the desired filter impulse responses of the solution in block 310 by inversing the DFT once all M complex frequency values are found. $H_r(i)$ are high pass, band pass or low pass filters and may include, for example, fourth order Butterworth filters. The forward pointing transducer is usually the tweeter 115, which requires $H_o$ to be a high pass filter of corner frequency (2 . . . 5) KHz (−3 dB).

The following iterative design procedure may be based on measured frequency responses of all drivers at incremental angles around the enclosure:

$$H_{DR}(q,r,i),$$

where q=1, . . . , Q is the angular index, r the driver (or driver pair) index, i the frequency index.

At block 320, the frequency responses are smoothed, and normalized to the frontal response of driver 1 (q=1, r=1). Due to symmetry, the data may be captured at a half circle 0 . . . 180° only, in typically 15° steps (Q=13).

At block 325, the system frequency responses at angle q, U(q, i), may be computed as the complex sum of all drivers, with beamforming filters applied:

$$U(q,i)=\Sigma_{r=0}^{n+1} C_r(i) H_{DR}(q,r,i).$$

At block 330, the processor 135 may determine a real-valued target function T(q, i) specifying the desired system responses based on the frequency responses.

At block 335, the processor 135 may apply a nonlinear optimization routine at each frequency point that minimizes the error:

$$e(i)=\sqrt{\Sigma_{q=1}^{Q} w(q)(|U(q,i)/a|-T(q,i))^2}.$$

where w(q) is a weighting function that can be used to improve the result at a desired angle, at the expense of other angles. The parameter a is the array gain that specifies how much louder the array plays compared to one single driver. Typically, the parameter is higher than one, but should not be higher than the total number of drivers. In order to allow some amount of sound cancellation that is necessary for super-directive beam forming, the array gain may be smaller than the number of drivers.

Instead of real and imaginary parts, magnitude $|C_r(i)|$ and phase $\arg(C_r(i))=\arctan(\mathrm{im}\{C_r(i)\}/\mathrm{Re}\{C_r(i)\})$ are selected for the nonlinear optimization routine as variables.

This bounded, nonlinear optimization problem can be solved with standard software. The following bounds are selected:

$$G_{max}=20*\log(\max(|C_r|)),$$

the maximum allowed filter gain, and lower and upper limits for the magnitude values from one calculated frequency point to the next point, specified by an input parameter 8

$$|C_r(i)|\cdot(1-\delta)<|C_r(i+1)|<|C_r(i)|\cdot(1+\delta)$$

In order to control smoothness of the resulting frequency response and ensure the solution does not deviate significantly from the above defined start solution $C_{r,start}$, the first frequency point in the band of interest is:

$$i = i_1 = \left[\frac{f_1}{f_a}\cdot N\right]$$

(for example $f_1$ = 300 Hz, $f_g$ = 24 KHz, $N$ = 2048 => $i_1$ = 25),

At block 340, the processor 135 increments the index and determines if all filter values are determined until the last point is reached:

$$i = i_2 = \left[\frac{f_2}{f_g} \cdot N\right] (\text{e.g. } f_2 = 3 \text{ KHz} \Rightarrow i_2 = 256).$$

The process 300 then ends.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

Aspects of the present embodiments may be embodied as a system, method or computer program product. Accordingly, aspects of the present disclosure may take the form of an entirely hardware embodiment, an entirely software embodiment (including firmware, resident software, microcode, etc.) or an embodiment combining software and hardware aspects that may all generally be referred to herein as a "module" or "system." Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Aspects of the present disclosure are described above with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general-purpose computer, special purpose computer, or other programmable data processing apparatus to produce a machine, such that the instructions, which execute via the processor of the computer or other programmable data processing apparatus, enable the implementation of the functions/acts specified in the flowchart and/or block diagram block or blocks. Such processors may be, without limitation, general purpose processors, special-purpose processors, application-specific processors, or field-programmable.

The flowcharts and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A loudspeaker system, comprising:

at least two transducers arranged within an enclosure and horizontally aligned with one another; and a processor configured to apply at least one filter to the at least two transducers to generate beamforming audio content, the processor configured to:

receive input channels, determine a desired filter impulse response at a first frequency point of the input channels, determine a frequency response of the desired filter impulse response at a first angle, generate a target function of a desired system response based on the frequency response for application at the first angle, and apply a nonlinear optimization routine to the target function at the first frequency point.

2. The system of claim 1, wherein the processor is further configured to increment the first frequency point to provide a second frequency point.

3. The system of claim 2, wherein the processor is further configured to determine whether filter values at each of the first frequency point and the second frequency point has been determined.

4. A loudspeaker system, comprising:

a plurality of transducers arranged within an enclosure; and a processor configured to:

receive input channels, determine a desired filter impulse response at one of a plurality of frequency points of the input channels, determine a frequency response of the desired filter impulse response at each of a plurality of angles, generate a target function based on the frequency response for application at the plurality of angles, apply at least one filter based on the target function to generate beamforming audio content at the plurality of transducers, and apply a nonlinear optimization routine to the target function at a first frequency point of the plurality of frequency points.

5. The system of claim 4, wherein the nonlinear optimization routine includes applying a gain parameter specific to one of the plurality of transducers.

6. The system of claim 5, wherein the processor is further configured to determine whether filter values at each of the first frequency point and the second frequency point has been determined.

7. The system of claim 4, wherein the processor is further configured to increment the first frequency point to provide a second frequency point.

8. The system of claim 4, wherein the plurality of angles include angles in a range of 15 to 180 degrees.

9. The system of claim 4, wherein the frequency response is a complex sum of the frequency responses of the plurality of transducers.

10. The system of claim 4, wherein the plurality of transducers are horizontally aligned with one another within the enclosure.

11. The system of claim 4, wherein the plurality of transducers are vertically aligned with one another within the enclosure.

12. The system of claim 11, wherein the processor is further configured to apply a nonlinear optimization routine to the target function at the frequency point, the nonlinear optimization routine includes applying a gain parameter between the range of 1 and 2.

13. The system of claim 4, wherein the enclosure is disc-shaped.

14. A method for active directivity control of a loudspeaker, comprising:

receiving input channels, determining a desired filter impulse response at one of a plurality of frequency points of the input channels, determining a frequency response of the desired filter impulse response at each of a plurality of angles, generating a target function based on the frequency response for application at the plurality of angles, applying at least one filter based on the target function to generate beamforming audio content at a plurality of transducers, and applying a nonlinear optimization routine to the target function at a first frequency point of the plurality of frequency points.

15. The method of claim 14, further comprising incrementing the first frequency point to provide a second frequency point.

16. The method of claim 15, further comprising determining whether filter values at each of the first frequency point and the second frequency point has been determined.

17. The system of claim 14, further comprising applying a gain parameter specific to one of the plurality of transducers.

* * * * *